US010368674B2

(12) United States Patent
Zuckerman et al.

(10) Patent No.: US 10,368,674 B2
(45) Date of Patent: Aug. 6, 2019

(54) GARMENT HANGER HAVING UNDER NOTCHES

(71) Applicant: BRAIFORM (HK) LTD., Kwun Tong (HK)

(72) Inventors: Andrew Zuckerman, New York, NY (US); Michael Warren, Bishops Stortford (GB)

(73) Assignee: BRAIFORM (HK) LTD., Kowloon Bay (HK)

( * ) Notice: Subject to any disclaimer, the term of this patent is extended or adjusted under 35 U.S.C. 154(b) by 6 days.

(21) Appl. No.: 15/417,855

(22) Filed: Jan. 27, 2017

(65) Prior Publication Data

US 2017/0208979 A1 Jul. 27, 2017

Related U.S. Application Data

(60) Provisional application No. 62/287,796, filed on Jan. 27, 2016.

(51) Int. Cl.

| | |
|---|---|
| ***A47G 25/48*** | (2006.01) |
| *A47G 25/30* | (2006.01) |
| *A47G 25/14* | (2006.01) |
| *A47G 25/18* | (2006.01) |

(52) U.S. Cl.

CPC ..... *A47G 25/482* (2013.01); *A47G 25/48* (2013.01); *A47G 25/1435* (2013.01); *A47G 25/183* (2013.01); *A47G 25/30* (2013.01)

(58) Field of Classification Search

CPC .... A47G 25/14; A47G 25/1492; A47G 25/20; A47G 25/26; A47G 25/30; A47G 25/34; A47G 25/442; A47G 25/482; A47G 25/485; A47G 25/486; A47G 25/487; A47G 25/1435; A47G 25/183; A47G 25/48

See application file for complete search history.

(56) References Cited

U.S. PATENT DOCUMENTS 2,099,596 A * 11/1937 Bruening ..... A47G 25/34 223/87
2,549,297 A * 4/1951 Dobana ..... A47G 25/34 223/88

(Continued)

FOREIGN PATENT DOCUMENTS

AT 12912 U1 * 2/2013
DE 4007320 A1 * 9/1991

(Continued)

*Primary Examiner* — Ismael Izaguirre
(74) *Attorney, Agent, or Firm* — Scully Scott Murphy and Presser

(57) ABSTRACT

A novel garment hanger with an under-notch is provided. The hanger has a hook and an elongated hanger body connected to the hook. The hanger body has a top surface for supporting a garment and an undersurface opposite the top surface. The hanger body has a retaining structure for retaining a portion of the garment. The retaining structure has a cantilever that extends under the undersurface of the hanger body. An under-notch is defined between the undersurface of the hanger body and the cantilever. A portion of the garment, such as a strap of the garment, is insertable into the under-notch to be positively retained in the under-notch.

8 Claims, 9 Drawing Sheets

(56) References Cited

U.S. PATENT DOCUMENTS

| | | | | | |
|---|---|---|---|---|---|
| 2,577,940 | A * | 12/1951 | Freeman | A47G 25/26 | 223/91 |
| 2,835,422 | A * | 5/1958 | Stuard | A47G 25/30 | 223/92 |
| 3,186,609 | A * | 6/1965 | Patch | A47G 25/20 | 223/88 |
| 4,623,079 | A * | 11/1986 | Tendrup | A47G 25/48 | 223/85 |
| 5,082,152 | A * | 1/1992 | Chen | A47G 25/442 | 211/117 |
| D340,138 | S * | 10/1993 | Gouldson | D6/326 | |
| D450,461 | S * | 11/2001 | Okiyama | D6/317 | |
| 6,516,980 | B1 * | 2/2003 | Goldman | A47G 25/48 | 223/85 |
| 8,302,826 | B2 * | 11/2012 | Gouldson | A47G 25/1421 | 223/95 |
| 8,910,837 | B2 * | 12/2014 | Wittenstein | A47G 25/32 | 223/89 |
| 2011/0057001 | A1 * | 3/2011 | Louw | A47G 25/485 | 223/85 |

FOREIGN PATENT DOCUMENTS

| | | | |
|---|---|---|---|
| JP | 2012115518 | A * | 6/2012 |
| WO | WO 9011036 | A1 * | 10/1990 |

* cited by examiner

GARMENT HANGER HAVING UNDER NOTCHES

BACKGROUND

The present disclosure relates generally to molded plastic garment hangers as are widely used for the purpose of shipping and displaying garments. More specifically, the present disclosure relates to top garment hangers with under-notches, which are suitable for all types of top garments and capable of providing satisfactory store representation of garments. In addition, the top garment hangers according to the present disclosure are easy to operate, cost-effective to manufacture and environmentally advantageous.

In the area of retail garment sales, so-called Garment-On-Hanger (GOH) programs have become preferred by retailers. In a GOH program, garments are delivered to retail merchants already suspended from hangers, where upon arrival at the retail location the garments are immediately placed on display for sale. One application of the GOH programs includes top garments such as coats, blazers, blouses, knitwear, shirts, jackets and the like. The garments are placed on a hanger and subsequently shipped from a distribution center to the retail establishment.

FIG. 1 shows a conventional top garment hanger 10, which includes a hook 12 and an elongated hanger body 14. A hollow protrusion 15 is provided on the top of the hanger body 14, within which the hook 12 is inserted to be upstanding from the hanger body 14. The hanger body 14 includes a pair of coplanar and oppositely directed arms 16 and 18 for hanging one or more garments.

A mechanism for retaining the straps of strapped garments is provided to each arm. Taking the arm 16 as an example, the retaining mechanism includes a top notch 17 that is formed from the top of the arm and a pair of overhangs 19 that partially cover the top notch 17. In use, the straps of the garments can be placed into the notches of the arms and held in place by the overhangs.

Certain deficiencies are inherent with the conventional top garment hangers as shown above. First, these top garment hangers are not suitable to be used with certain types of top garments, such as, sweaters. In this case, the sweaters (or any loose weave garments) are prone to be caught by the overhangs of the hangers, which can cause damage to the garments. To solve this problem, retailers typically need to replace the top-notched hangers with hangers having a smooth top surface, when displaying sweaters. Thus, the conventional top garment hangers are not versatile for different types of top garments.

Furthermore, for certain top garments (such as, top garments having relatively heavy fabrics), a part of the garments sinks or sags into the top notches during presentation. As a result, the overall presentation of the garments is compromised and thus, unsatisfactory. More importantly, the apparel material sagging into the top notch may cause damage, return or discount of the garments.

Store analysis also indicates that the provision of notches in the top of the garment hangers detracts from the presentation of the garments per se and is in general not welcome by the customers.

In addition, in view of the provision of the top notches, a non-slip material or surface cannot be applied to the top of the hanger arms where the top notches are provided. For certain top garments (such as, scoop neck type garments), non-slip surfaces are typically required to prevent the garments from falling off the hangers. In this regard, the conventional top garment hangers having top notches are not satisfactory, as the non-slip surfaces cannot be applied as required.

As a result of the inherent deficiencies of the conventional top garment hangers, additional hangers (such as, top garment hangers without the top notches or top garment hangers with non-slip surfaces) are required to accommodate the need of hanging and displaying different top garments. These conventional garment hangers are less versatile, which leads to environmental concerns, as more raw material and energy will be consumed for making the hangers.

Accordingly, there is a need in the industry for improved top garment hangers, which overcome the inherent deficiencies of the conventional top garment hangers and provide a more environmentally friendly product.

SUMMARY

According to an exemplary aspect of the present disclosure, a garment hanger is provided. The garment hanger includes an elongated hanger body, which includes a middle portion and a pair of arms extending oppositely from the middle portion. The hanger further includes a hook connected to the middle portion. The hanger body has a top surface for supporting a garment and an undersurface opposite the top surface. The garment hanger further includes a first cantilever extending under the undersurface of the hanger body. The first cantilever includes a fixed end connected to a hanger arm and a free end opposite the fixed end. An under-notch is formed between the undersurface of the hanger body and the first cantilever, into which a portion of the garment is insertable.

BRIEF DESCRIPTION OF THE DRAWINGS

The foregoing objects and advantages of the present invention may be more readily understood by one skilled in the art with reference to the following detailed description of several embodiments thereof, taken in conjunction with the accompanying drawings in which.

DETAILED DESCRIPTION OF THE EMBODIMENTS

Figure 1:
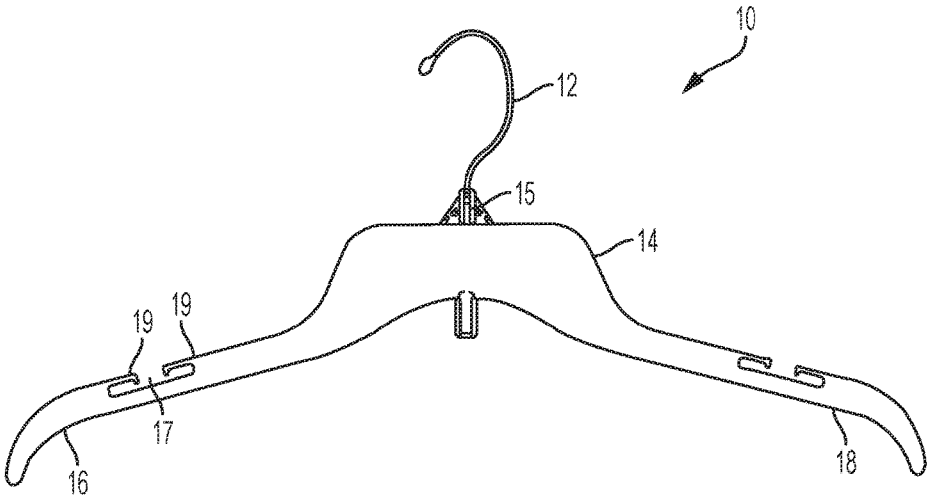
FIG. 1 is a front elevation view of a conventional top garment hanger, which has top notches.
Figure 2:
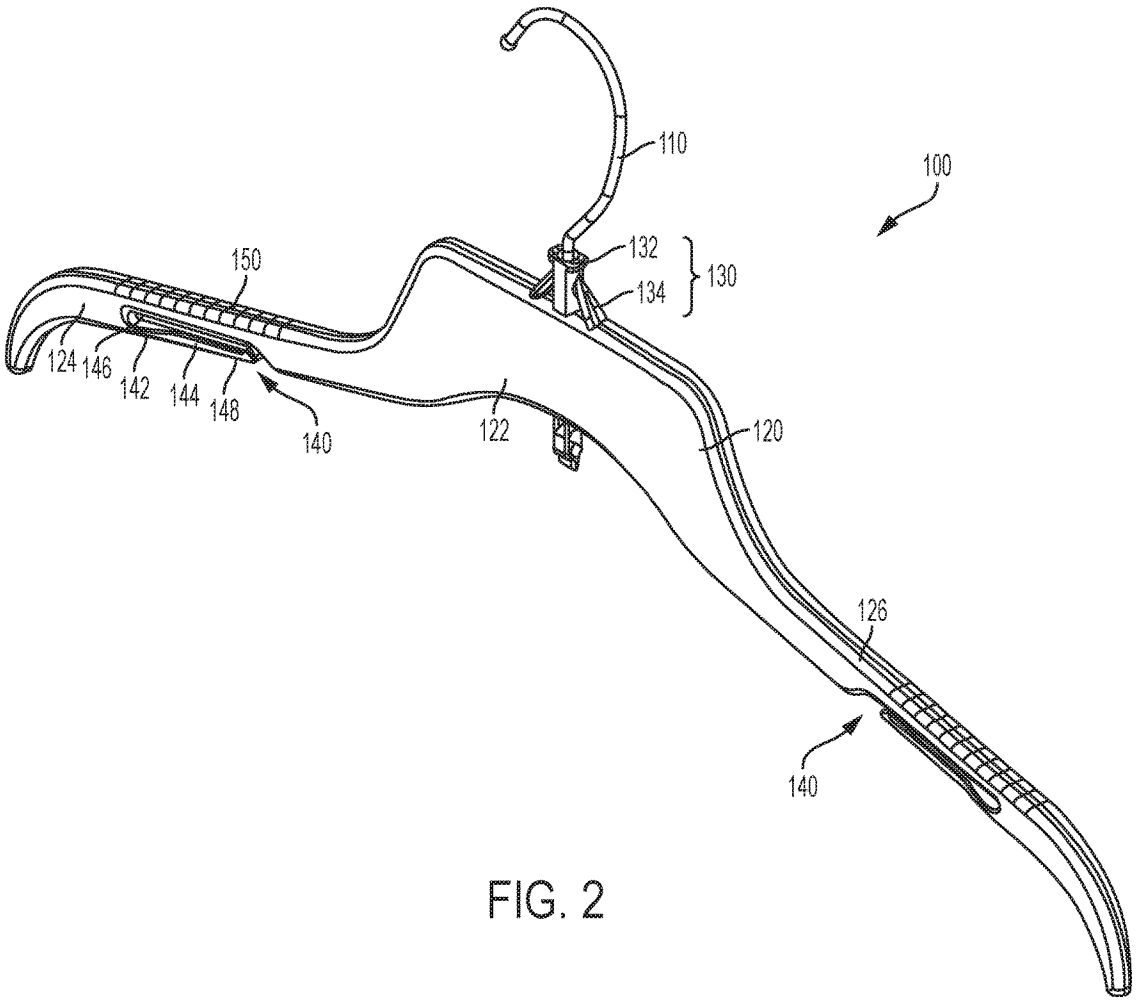
FIG. 2 is a perspective view of a garment hanger with a strap retaining mechanism, according to an exemplary embodiment of the present disclosure.
Figure 3:
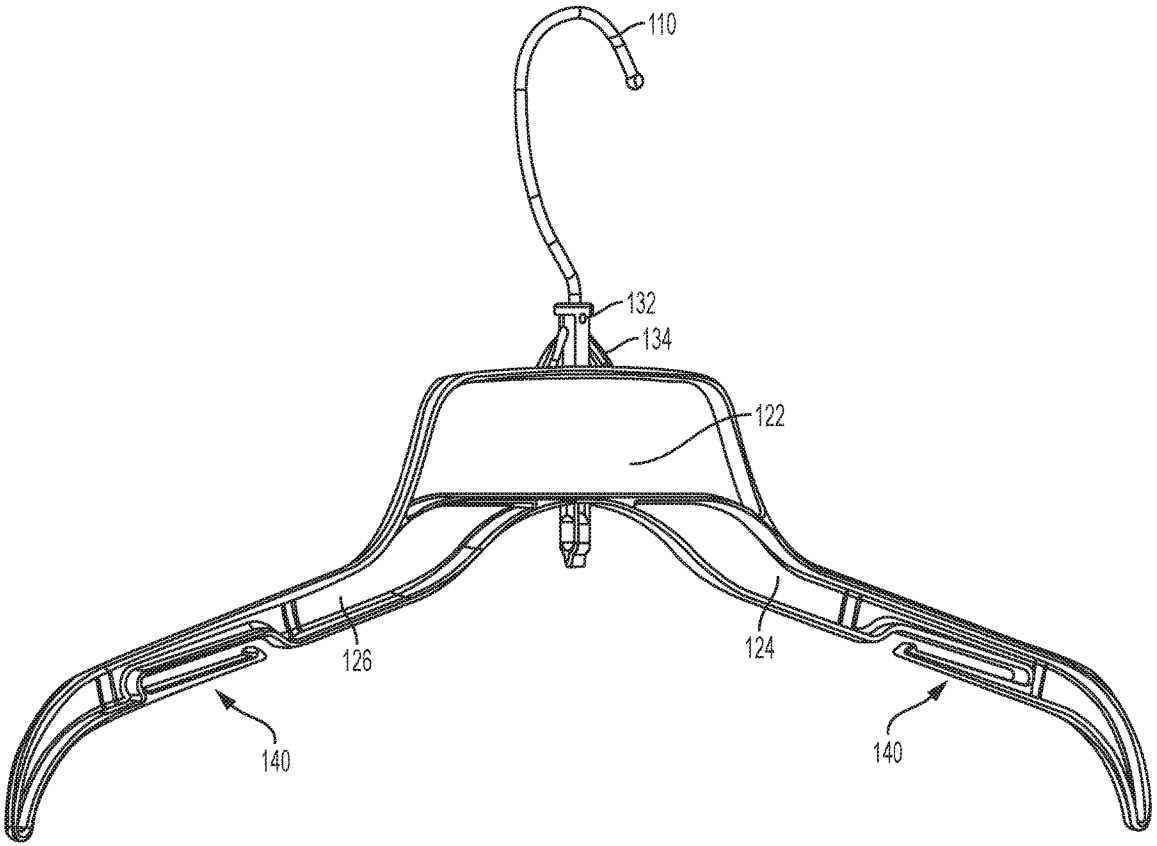
FIG. 3 is an alternative perspective view of the garment hanger shown in FIG. 2.

Referring now in detail to the drawings, and particularly the hanger construction as shown in FIGS. 2 and 3, there is a garment hanger 100, such as, a molded plastic top garment hanger, according to an exemplary embodiment of the present disclosure.

The top garment hanger 100 includes a hook 110, which can be made of a suitable metal or plastic material. The top garment hanger 100 also includes an elongated hanger body or beam 120. The hook 110 substantially extends upright from the hanger body 120. A hook support 130 is provided on top of the hanger body 120, at the lower neck region of the hanger 100. The hook support 130 includes a protrusion 132 and a pair of ribs 134 disposed angularly with respect to the protrusion 132. The protrusion 132 is hollow to provide a cavity, into which a straight portion of the hook 110 is fixedly inserted. The hanger body 120 includes a middle portion 122 and a pair of arms 124 and 126 that are substantially coplanar with the middle portion 122 and extend oppositely from the middle portion. The arms 124 and 126 can also extend downwardly from the hanger body 120 at the opposite distal ends of the arms.

Figure 8:
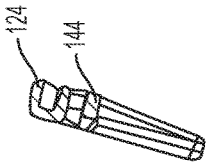
FIG. 8 is a sectional view along lines 8-8 of FIG. 5.
Figure 7:
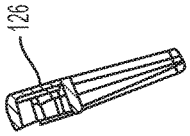
FIG. 7 is a sectional view along lines 7-7 of FIG. 5.
Figure 6:
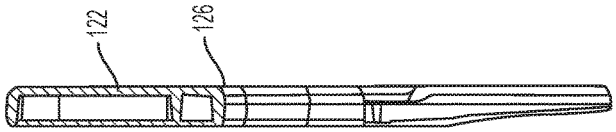
FIG. 6 is a sectional view along lines 6-6 of FIG. 5.
Figure 9:
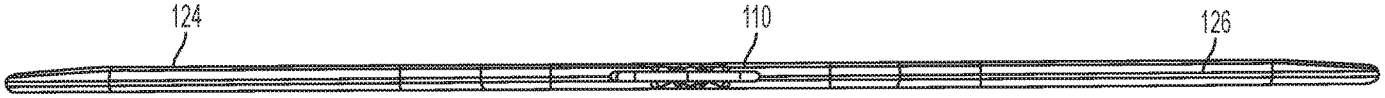
FIG. 9 is a top plan view of the garment hanger shown in FIG. 2.
Figure 10:
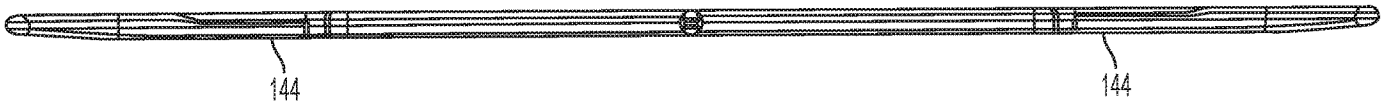
FIG. 10 is a bottom plan view of the garment hanger shown in FIG. 2.

As shown in FIG. 3, the hanger body 120 has a substantially C-shaped cross-section, which provides required structural strength for the hanger 100 and support for top garments. Other cross-sectional beam geometries, including 'I', 'square-m', and 'U', among others, may be substituted without departing from the scope of the disclosure. The details of the C-shaped cross-section are also shown in FIGS. 6-8. As shown, each of the middle portion 122, the first arm 124 and the second arm 126 can have a substantially C-shaped cross-section.

Now referring back to FIG. 2, at least one strap retaining mechanism 140 is provided to the first arm 124 and/or the second arm 126. The strap retaining mechanism 140 is provided at the lower portion of the hanger arms.

Taking the first arm 124 as an example, the strap retaining mechanism 140 includes an under-notch (or a cavity) 142 formed through the first arm 124 at the lower portion of the first arm 124. The strap retaining mechanism 140 also includes a cantilever 144 having a fixed end 146 connected to the first arm 124 and a free end 148 opposite to the fixed end 146 and extending into the notch 142. The notch 142 is substantially surrounded by the cantilever 144 and the first arm 124, to provide a substantially enclosed space for receiving a portion (such as, a strap) of a top garment. The free end 148 and the first arm 124 together define an entrance, through which the portion of the garment can be placed into the notch 142. An elevation can be provided on the top surface of the free end 148, which serves to prevent the portion of the garment from being inadvertently removed from the notch 142. The elevation can have a triangular profile.

A non-slip surface (or insert) 150 can be provided to the top surface of the first arm 124 and/or the second arm 126, as shown in FIG. 2. The non-slip surface 150 can be made of any suitable material or structure. For example, the non-slip surface 150 can be provided at a place of the top surface of the first arm 124 and/or the second arm 126, which is above the notch 142. The provision of the non-slip surface 150 permits the top garment hanger 100 to be used with certain top garments (such as, scoop neck type garments) to prevent slipping of the garments from the hangers.

Figure 4:
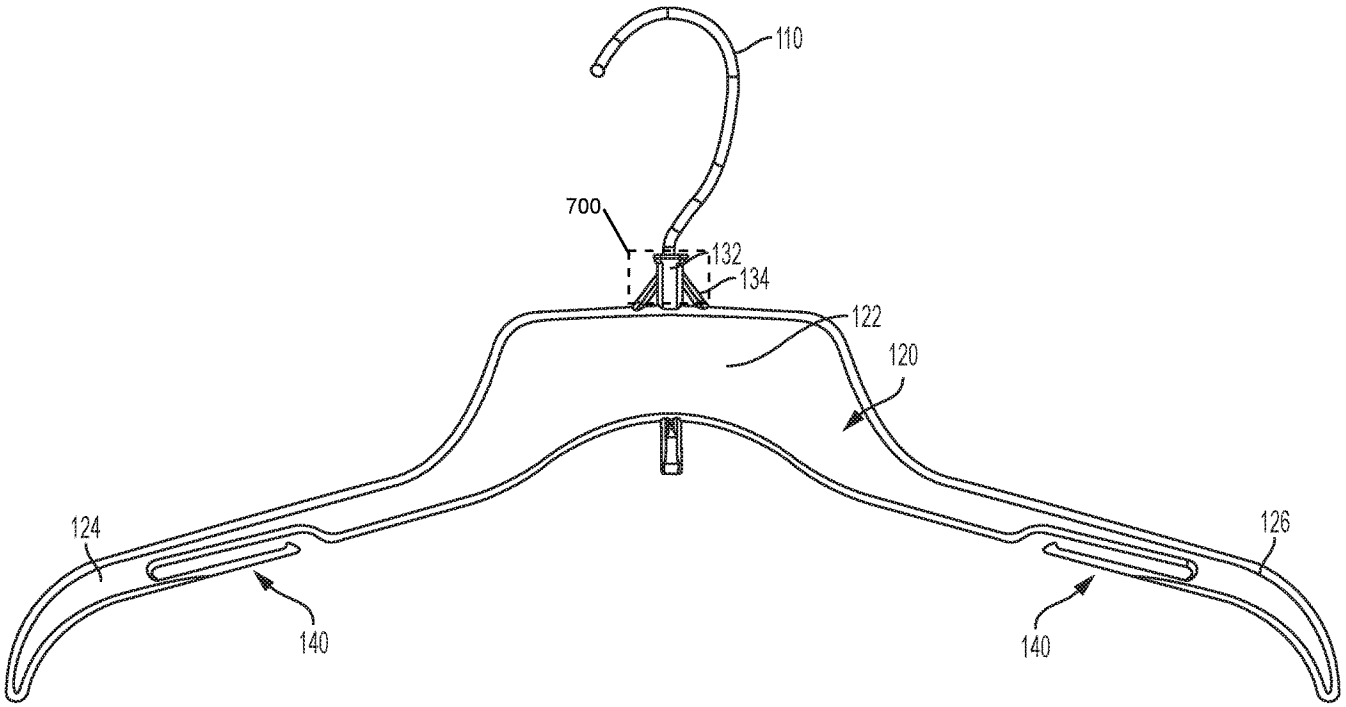
FIG. 4 is a front elevation view of the garment hanger shown in FIG. 2.
Figure 5:
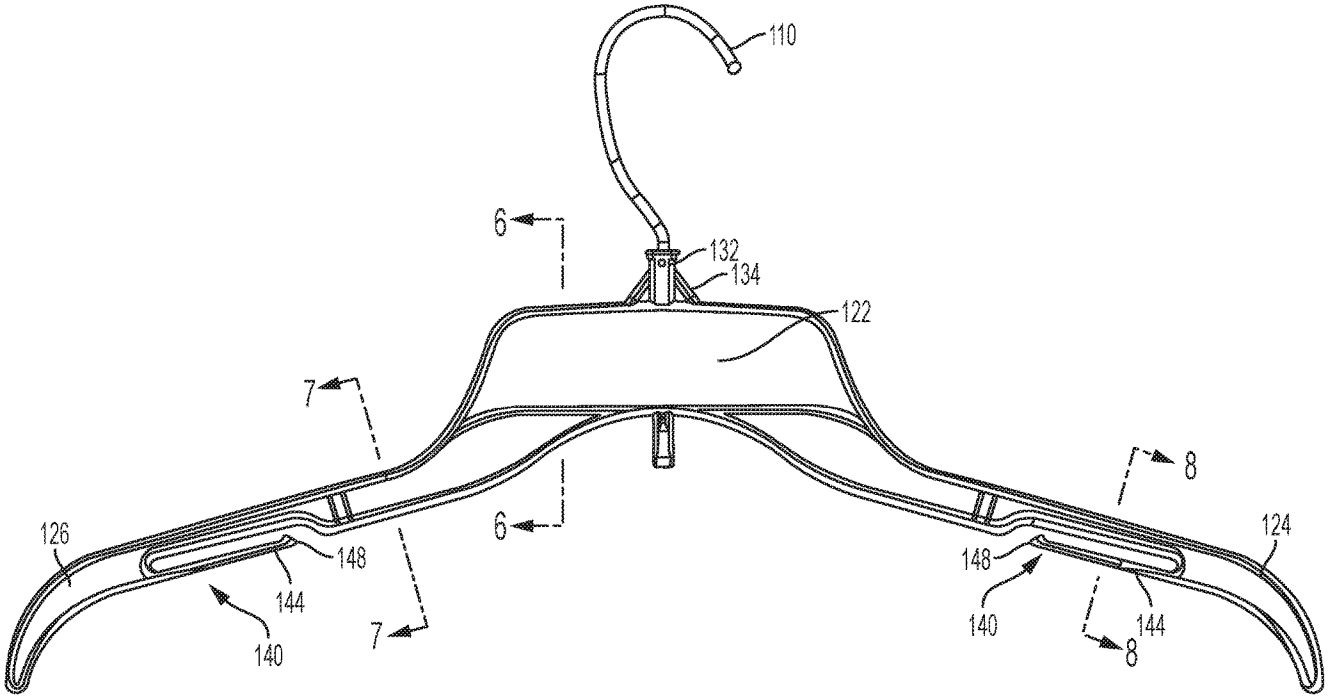
FIG. 5 is a rear elevation view of the garment hanger shown in FIG. 2.
Figure 11:
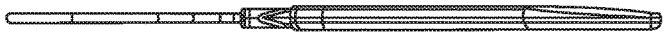
FIG. 11 is a side elevation view of the garment hanger shown in FIG. 2.

A crest sizer or a lower neck indicator 700, as shown in FIG. 4, can be detachably mounted to the hook support 130, at the lower neck region of the hanger, for displaying information related to the garments, such as, sizes of the garments.

The top garment hanger 100, as shown and described above, is versatile and can be used with all types of top garments in an interchangeable manner. Thus, the cost for manufacturing different top garment hangers tailored for specific top garments and the cost for shipping and storing these different hangers can be minimized. Significant savings on raw material and energy for manufacturing top garment hangers can also be achieved.

The top garment hanger 100, as shown and described above, does not compromise the presentation and the quality of top garments. For example, when the hanger is used to hang and display sweaters or any loose weave garments, the garments will not be caught by the cantilever 144, because the strap retaining mechanism is provided beneath the hanger arms and the garments are placed on the smooth top surfaces of the hanger. Furthermore, when the hanger 100 is used to hang and display top garments, no sagging or sinking of the material of the top garments will occur. Thus, a satisfactory presentation of the top garments can be maintained and the undesirable damage, return and discount of the garments can be avoided.

The top garment hanger 100, as shown and described above, avoids use of top notches, which detracts from the presentation of the garments, at least because the under-notch is built into the body of the hanger.

The top garment hanger 100, as shown and described above, allows straps of the strapped garments to be easily inserted into the under-notches and held by gravity. Thus, it is easy and convenient for store employees and customers to use the top garment hanger.

Figure 12:
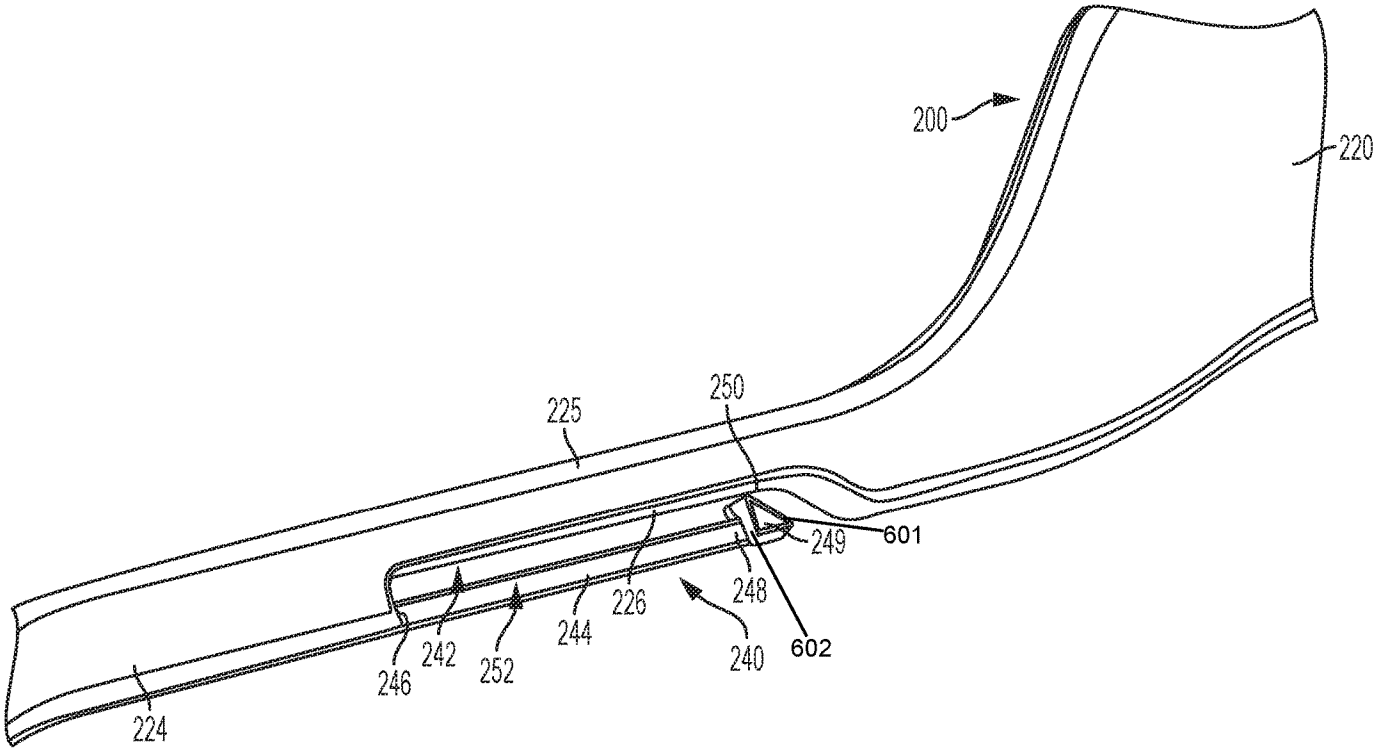
FIG. 12 is a partial perspective view of a garment hanger having a strap retaining mechanism according to another exemplary embodiment of the present disclosure.

FIG. 12 illustrates a garment hanger 200, according to another exemplary embodiment of the present disclosure. The garment hanger 200 can be, for example, a top garment hanger. The garment hanger 200 includes a hanger body 220. Although not shown, the hanger 200 further includes a hook and a hook support, which are the same as or similar to the hook 110 and the hook support 130 of the hanger 100. The hanger body 220 includes a pair of arms that extend oppositely from each other. For brevity purpose, only a first arm 224 is shown in the figure; and the second arm is a mirror image of the first arm 224. The garment hanger 200 further includes a strap retaining mechanism 240, which is provided under the top surface 225 of the first arm 224. A same strap retaining mechanism can be provided to the second arm. As shown in FIG. 12, the strap retaining mechanism 240 includes an under-notch (or a cavity) 242 formed within the first arm 224 at the lower portion of the first arm 224. The under-notch 242 is formed to extend through the first arm 224 from the front surface to the rear surface of the first arm 224. The strap retaining mechanism 240 further includes a cantilever 244 extending under an undersurface 226 of the first arm 224 The cantilever 244 has a fixed end 246 connected to the first arm 224. The cantilever 244 also has a free end 248 opposite to the fixed end 246. The under-notch 242 is substantially bordered by the cantilever 244 and the undersurface 226 of the first arm 224. Thus, the under-notch 242 is suitable for receiving a portion (such as, a strap) of a top garment. An elevation 249, substantially in the shape of a triangle when viewed from the front of the hanger 200, is formed to the free end 248 to extend upwardly toward the undersurface 226 of the hanger arm 224. The elevation 249 and the undersurface 226 together define an entrance 250.

The cantilever 244 is made of a resilient material (such as, a plastic material), such that, when the hanger 200 is in use, the free end 248 and the elevation 249 can be manipulated to slightly move vertically. As a result, the entrance 250 can be temporarily enlarged for a portion (such as, a strap) of a garment to pass through the entrance 250 and to be accommodated in the under-notch 242. Once the portion of the garment is positively received in the under-notch 242, the free end 248 and the elevation 249 return to their original positions, to prevent the strap of the garment from inadvertently and undesirably slipping off the cantilever 244. The slanted surface 601 of the triangular elevation 249 faces away from the cantilever 244, which facilitates insertion of the strap of the garment into the under-notch 242. A substantially vertical or upright surface 602 of the triangular elevation 249 faces toward the cantilever 244, which prevents undesirable slipping-off of the strap of the garment from the cantilever 244.

The cantilever 244 has a recess 252 between the fixed end 246 and the free end 248. The recess 252 extends rearwardly from the front surface of the hanger body 220, for providing an additional space into which a portion of a garment can be accommodated. Optionally, the cantilever 244 can have another recess (not shown), which extends frontwardly from the rear surface of the hanger body 220.

A non-slip surface or insert (not shown) can be provided to the top surface 225 of the first arm 224. The provision of the non-slip surface permits the garment hanger to be used with certain top garments (such as, scoop neck type garments) to prevent slipping of the garments from the hangers.

A crest sizer (not shown) can be detachably mounted to the hook support of the garment hanger 200, at the lower neck region of the hanger, for displaying information related to the garments, such as, sizes of the garments.

The top garment hanger 200, as shown and described above, is versatile and can be used with all types of top garments in an interchangeable manner. Thus, the cost for manufacturing different top garment hangers tailored for specific top garments and the cost for shipping and storing these different hangers can be minimized. Significant savings on raw material and energy for manufacturing top garment hangers can also be achieved.

The top garment hanger 200, as shown and described above, does not compromise the presentation and the quality of top garments. For example, when the hanger is used to hang and display sweaters or any loose weave garments, the garments will not be caught by the cantilever, because the strap retaining mechanism is provided beneath the hanger arms and the garments are placed on the smooth top surfaces of the hanger. Furthermore, when the hanger 200 is used to hang and display top garments, no sagging or sinking of the material of the top garments will occur. Thus, a satisfactory presentation of the top garments can be maintained and the undesirable damage, return and discount of the garments can be avoided.

The top garment hanger 200, as shown and described above, avoids use of top notches, which detracts from the presentation of the garments, at least because the under-notch is built into the body of the hanger.

The top garment hanger 200, as shown and described above, allows straps of the strapped garments to be easily inserted into the under-notches and held by gravity. Thus, it is easy and convenient for store employees and customers to use the top garment hanger.

Figure 13:
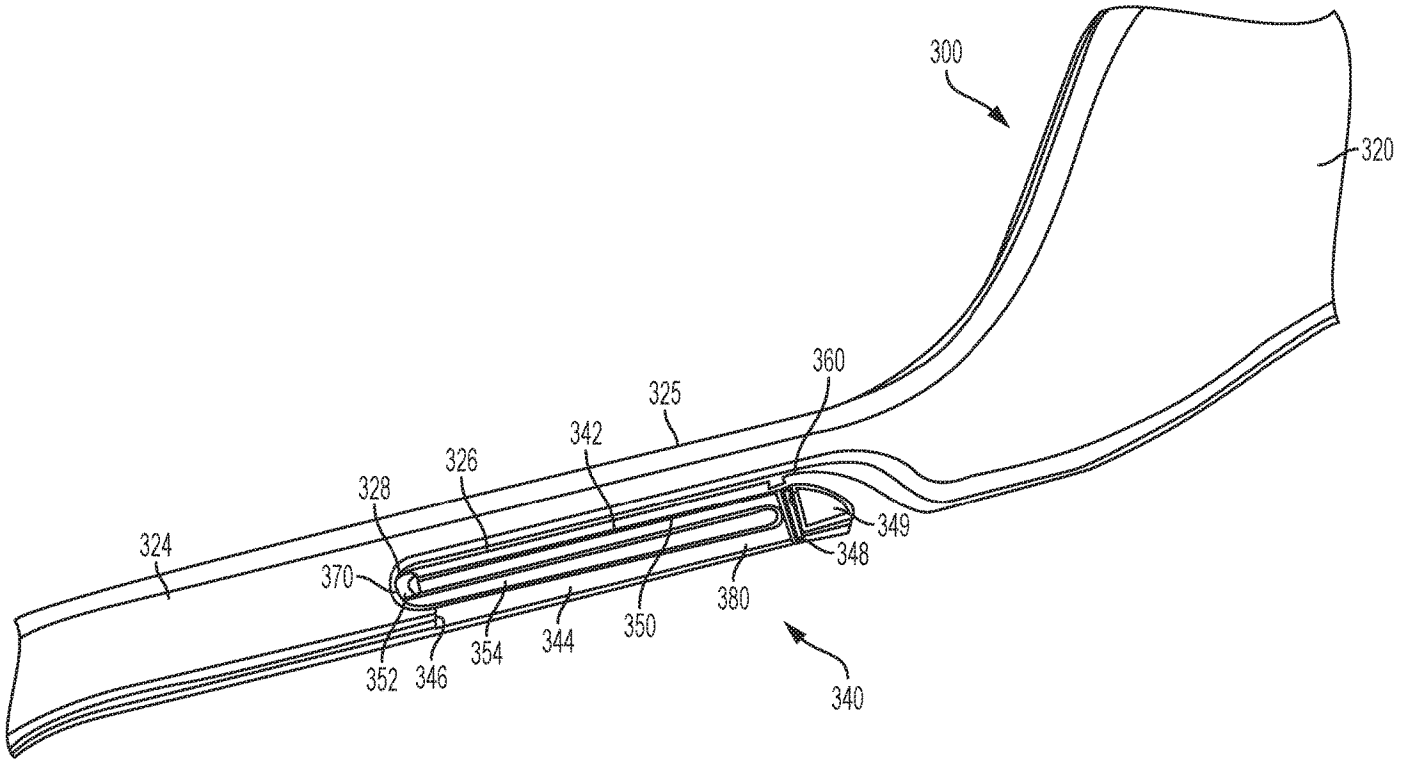
FIG. 13 is a partial perspective view of a garment hanger having a strap retaining mechanism according to yet another exemplary embodiment of the present disclosure.

FIG. 13 illustrates a garment hanger 300, according to yet another embodiment of the present disclosure. The garment hanger 300 can be, for example, a top garment hanger. The garment hanger 300 includes a hanger body 320. Although not shown, the hanger 300 further includes a hook and a hook support, which are the same as or similar to the hook 110 and the hook support 130 of the hanger 100. The hanger body 320 includes a pair of arms that extend oppositely from each other. For the purpose of brevity, only a first arm 324 is shown in the figure; and the second arm is a mirror image of the first arm 324. The garment hanger 300 further includes a strap retaining mechanism 340, which is provided under the top surface 325 of the first arm 324. A same strap retaining mechanism can be provided to the second arm.

As shown in FIG. 13, the strap retaining mechanism 340 includes an under-notch (or a cavity) 342 formed within the first arm 324 at the lower portion of the first arm 324. The under-notch 342 is formed to extend through the first arm 324 from the front surface to the rear surface of the first arm 324. The strap retaining mechanism 340 further includes a first cantilever 344 extending under the under-notch 342. The first cantilever 344 has a fixed end 346 connected to the first arm 324. The first cantilever 344 also has a free end 348 opposite to the fixed end 346. The strap retaining mechanism 340 further includes a second cantilever 350 formed integrally with the free end 348. The second cantilever 350 extends from the free end 348 toward the fixed end 346. The second cantilever 350 also has a free end 352. The free end 352 faces toward a curved inner side surface 328 of the hanger 300, which is continuous with an undersurface 326 of the first arm 324. A space 354 is provided between the first cantilever 344 and the second cantilever 350.

The under-notch 342 is substantially bordered by the second cantilever 350 and the undersurface 326 of the first arm 324. The under-notch 342 is suitable for receiving a portion (such as, a strap) of a top garment. An elevation 349, substantially in the shape of a triangle when viewed from the front of the hanger 300, is formed on the free end 348 to extend upwardly toward the undersurface 326 of the hanger arm 324. The elevation 349 and the undersurface 226 together define a first entrance 360. In addition, the free end of 352 of the second cantilever 350 and the curved inner side surface 328 of the hanger 300 together define a second entrance 370.

Both the first cantilever 344 and the second cantilever 350 are made of a resilient material (such as, a plastic material). When the hanger 300 is in use, the free end 348 and the elevation 349 can be manipulated to slightly move up and down. As a result, the first entrance 360 can be temporarily enlarged for a portion (such as, a strap) of a garment to pass through the first entrance 360 and to be accommodated in the under-notch 342. Optionally, the portion of the garment is manipulated to pass through the second entrance 370 and to be received in the space 354. Both the under-notch 342 and the space 354 can be used to positively receive the portion of the garment, depending on the circumstances.

Once the portion of the garment is positively received in the under-notch 342 or the space 354, both the first cantilever 344 and the second cantilever 350 return to their original positions. As a result, the strap of the garment can be prevented from inadvertently and undesirably slipping off the strap retaining mechanism 340. The slanted surface of the triangular elevation 349 faces away from the cantilever 344, which facilitates insertion of the strap of the garment into the under-notch 342.

Both the first cantilever 344 and the second cantilever 350 have a recess 380 longitudinally between the fixed end 346 and the free end 348. The recess 380 extends rearwardly from the front surface of the hanger body 320, for providing an additional space into which a portion of a garment can be accommodated. Optionally, both the first cantilever 344 and the second cantilever 350 can have another recess (not shown), which extends frontwardly from the rear surface of the hanger body 320.

A non-slip surface or insert (not shown) can be provided to the top surface 325 of the first arm 324. The provision of the non-slip surface permits the garment hanger to be used with certain top garments (such as, scoop neck type garments) to prevent slipping of the garments from the hangers.

A crest sizer (not shown) can be detachably mounted to the hook support of the garment hanger 300, at the lower neck region of the hanger, for displaying information related to the garments, such as, sizes of the garments.

The top garment hanger 300, as shown and described above, is versatile and can be used with all types of top garments in an interchangeable manner. Thus, the cost for manufacturing different top garment hangers tailored for specific top garments and the cost for shipping and storing these different hangers can be minimized. Significant savings on raw material and energy for manufacturing top garment hangers can also be achieved.

The top garment hanger 300, as shown and described above, does not compromise the presentation and the quality of top garments. For example, when the hanger is used to hang and display sweaters or any loose weave garments, the garments will not be caught by the cantilever, because the strap retaining mechanism is provided beneath the hanger arms and the garments are placed on the smooth top surfaces of the hanger. Furthermore, when the hanger 300 is used to hang and display top garments, no sagging or sinking of the material of the top garments will occur. Thus, a satisfactory presentation of the top garments can be maintained and the undesirable damage, return and discount of the garments can be avoided.

The top garment hanger 300, as shown and described above, avoids use of top notches, which detracts from the presentation of the garments, at least because the under-notch is built into the body of the hanger.

The top garment hanger 300, as shown and described above, allows straps of the strapped garments to be easily inserted into the under-notches and held by gravity. Thus, it is easy and convenient for store employees and customers to use the top garment hanger.

With the continuing consumption of the natural resources, it is popular and necessary in the manufacturing industry to optimize the product design to save materials and energy and, concomitantly, reduce the manufacturing and transportation costs, without compromising performance. The resultant product under such a material and energy saving concept is recognized as an environmentally friendly product, and is much more market competitive than its prior art counterpart. In the hanger molding industry, millions of plastic hangers are manufactured each year. The top garment hanger having under-notches, as shown and described above, are environmentally friendly and provide a commercial advantage to the manufacturers, transporters and retailers in the industry.

The hanger of the present disclosure can be formed of one or more of polystyrene, SAN, ABS, PPO, nylon, polypropylene (PP), polyethylene, PET, polycarbonates (PC), acrylics, K-resin, and polyvinyl chloride (PVC) among others.

From the foregoing illustrations it is readily apparent that the present disclosure is directed to an improved top garment hanger suitable for industry mass production. The present disclosure offers reliable mechanical performance and structural integrity to the hangers, satisfying industry standards, such as, the VICS standards. Moreover, the production of such hangers is environmentally advantageous.

We claim:

1. A garment hanger comprising:

an elongated hanger body comprising a middle portion and a pair of arms extending oppositely from the middle portion, at least one of the hanger arms comprising:

a top flange having a top surface for supporting a garment, a bottom flange opposite the top flange, wherein the bottom flange has a bottom surface, and a web provided between the top flange and the bottom flange, wherein the web has an undersurface;

a hook connected to the middle portion;

a first cantilever extending under the undersurface of the hanger body, the first cantilever comprising a fixed end connected to a hanger arm, the first cantilever comprising a free end opposite the fixed end, wherein the free end of the first cantilever is the terminal end that is the farthest from the fixed end, wherein the first cantilever has a bottom surface and the bottom surface of the first cantilever is continuous and flush with the bottom surface of the bottom flange;

an under-notch formed between the undersurface of the hanger body and the first cantilever, wherein a portion of the garment is insertable into the under-notch; and a second cantilever, wherein the second cantilever is connected to the free end of the first cantilever and extends toward the fixed end of the first cantilever, wherein the second cantilever comprises a free end proximal to the fixed end of the first cantilever, wherein the second cantilever is provided between the first cantilever and the undersurface of the hanger body, wherein the free end of the second cantilever faces an inner side surface of the hanger body to define a second entrance with the inner side surface, wherein the inner side surface is continuous with the undersurface of the hanger body, wherein the second cantilever is distanced from the first cantilever to define a space therebetween, and wherein the portion of the garment is insertable into the space between the first cantilever and the second cantilever, after passing through the second entrance.

2. The garment hanger according to claim 1, further comprising an elevation formed with the free end of the first cantilever;

wherein the elevation extends upwardly toward the undersurface of the hanger body; and wherein the elevation and the undersurface of the hanger body together define an entrance, through which the portion of the garment passes to be insertable into the under-notch.

3. The garment hanger according to claim 2, wherein the elevation has a substantially triangular profile; and wherein the triangular profile of the elevation has a substantially slanted surface facing away from the free end, for facilitating the portion of the garment to pass through the entrance.

4. The garment hanger according to claim 3, wherein the triangular profile of the elevation has a substantially upright surface facing toward the free end, for preventing the portion of the garment from slipping off the first cantilever.

5. The garment hanger according to claim 1, further comprising a first recess extending from a front surface of the hanger body toward an opposite rear surface of the hanger body, wherein the portion of the garment is receivable in the first recess.

6. The garment hanger according to claim 5, further comprising a second recess extending from the rear surface of the hanger body toward the front surface of the hanger body, wherein the portion of the garment is receivable in the second recess.

7. The garment hanger according to claim 1, further comprising a non-slip material formed on the top surface of the hanger body for preventing the garment from slipping off the hanger body.

8. The garment hanger according to claim 1, further comprising a lower neck indicator mountable to a lower neck region of the hanger body, for displaying information related to the garment.

* * * * *